United States Patent [19]

McVay et al.

[11] 4,178,855

[45] Dec. 18, 1979

[54] EXPLOSIVE ACTUATED ARMING SWITCH DEVICE

[75] Inventors: James V. McVay; Patrick A. Yates, both of China Lake, Calif.

[73] Assignee: The United States of America as represented by the Secretary of the Navy, Washington, D.C.

[21] Appl. No.: 890,561

[22] Filed: Mar. 20, 1978

[51] Int. Cl.[2] ..... H01H 39/00; F42C 15/00

[52] U.S. Cl. ..... 102/262; 200/61.08; 102/7.2

[58] Field of Search ..... 200/61.08; 102/262, 102/272, 7.2; 174/525, 52 H; 361/397

[56] References Cited

U.S. PATENT DOCUMENTS

| | | | |
|---|---|---|---|
| 3,072,500 | 1/1963 | Berlinghof | 428/164 X |
| 3,745,276 | 7/1973 | McPherson | 200/61.08 X |
| 3,751,613 | 8/1973 | Inose et al. | 200/61.08 X |
| 3,824,328 | 7/1974 | Ting et al. | 174/52 S X |
| 3,846,823 | 11/1974 | Matthews et al. | 174/52 H X |
| 3,905,015 | 9/1975 | Inose et al. | 200/61.08 X |
| 4,088,828 | 5/1978 | Yamamoto et al. | 361/397 X |

OTHER PUBLICATIONS

Standard Handbook for Electrical Engineers, "Properties of Materials-Ceramic Insulators", Sec. 4-374, p. 180, 10th Ed., McGraw Hill, New York, N.Y.

*Primary Examiner*—James R. Scott
*Attorney, Agent, or Firm*—R. S. Sciascia; W. Thom Skeer; Kenneth G. Pritchard

[57] ABSTRACT

A conductor plated on a frangible substrate. The unit is potted in a silicon base compound, placed in a header, and attached to a printed circuit board. This assembly is then encased in a housing using epoxy resin potting compound. The circuit is protected from breakage due to mechanical shock by the epoxy resin but is immediately broken by an explosive shock wave which fractures the substrate and the conductor and opens the circuit.

9 Claims, 7 Drawing Figures

EXPLOSIVE ACTUATED ARMING SWITCH DEVICE

BACKGROUND OF THE INVENTION

1. Field of the Invention

This invention relates to the field of explosive indicators. More particularly this invention relates to frangible circuits. In still greater particularity the invention relates to a conductor which is plated on a frangible substrate and is fractured by shock waves from an explosive force but is protected from external mechanical shocks by a resilient potting compound.

2. Description of the Prior Art

Devices for making or breaking electrical circuits have been used for a variety of purposes. These circuits have been used to signal other devices upon the occurrence of certain events. One such system uses the breaking of a circuit affixed to a window to trigger an alarm. The breaking of the window is the event with the concurrent breaking of the circuit providing the signal to trigger the alarm.

A frangible printed circuit which may be broken by a bending force is shown in U.S. Pat. No. 3,072,500 issued to William L. Berlinghof on Jan. 8, 1963. this device provides for circuit breakage due to mechanical or bending force and, while suitable for this purpose, it would be less than satisfactory where only explosive signals are to be recognized.

One recent application of devices for making or breaking electrical circuits has been their use as a part of a vehicle collision detecting apparatus. Such a device is illustrated in U.S. Pat. No. 3,905,015 issued to Fumiyiki Inose on Sept. 9, 1975. In that device, a metal film is deposited on a glass substrate by evaporative deposition. The element is attached to a vehicle at a point where deformation is likely to occur. Lead wires, attached to the conducting metal film, convey a signal to a detecting circuit and actuate an airbag which is used for protection of the vehicle operator. While it is satisfactory for its intended purpose, the device is extremely frangible and, as such, is less satisfactory for use in situations where it is undesired, or even mandatory, that mechanical shock not break the circuit. Such would be the case if it is required to have the device recognize only an explosive shock.

Prior devices for monitoring an explosive event have used explosive force to bend metallic electrical contacts from an open circuit to a closed circuit configuration. The reliability of these devices is subject to question since the magnitude and direction of the explosive force is not completely predictable. In addition, switches of this type are relatively costly. Another disadvantage of the explosive switch is the relatively long activation time which may be on the order of 20 milliseconds. The present invention provides a reliable, cheap device which can perform the switching function in 100 microseconds.

SUMMARY OF THE INVENTION

The invention utilizes a frangible substrate having a gold conductor plated thereon. This frangible circuit is potted in a resilient elastomeric compound, placed in a typical commercial transistor container base or header, provided with a cover, and attached to a printed circuit board. The unit is then placed in a housing and again potted. Lead wires, attached to opposite ends of the conductor, provide an electrical signal with the conductor providing a known resistance. An explosive shock wave fractures the conductor whereupon the circuit is broken and the increase in resistance is sensed through the lead-wires. In the operative environment, as described below, the explosive signal is sensed and mines are armed as they fall from a cannister which has been split by the shaped explosive cutting charge. It is the explosive shock wave from the explosive charge that fractures the conductor. A characteristic of the explosive shock wave is that it possesses a large time and spatial gradient. The invention utilizes several ways of encapsulating the frangible circuit in a resilient medium. By doing so, the frangible circuit is made impervious to mechanical shock waves with small time and spatial gradients as would be associated with impacts or large value accelerations. Accidental arming of the mines is thereby prevented.

DESCRIPTION OF THE PREFERRED EMBODIMENT

Figure 1:
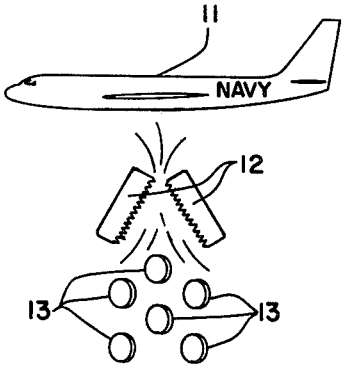
FIG. 1 shows an aircraft releasing a cannister containing mines.

Referring to FIG. 1, an aircraft 11 releases a cannister 12 which is split by a shaped explosive cutting charge (not shown). The shaped explosive cutting charge causes the present invention to activate a plurality of mines 13 which are being released to fall upon a surface 14.

Figure 2:
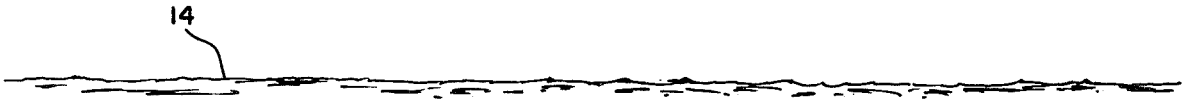
FIG. 2 shows the placement of the invention in the cannister.
Figure 2:
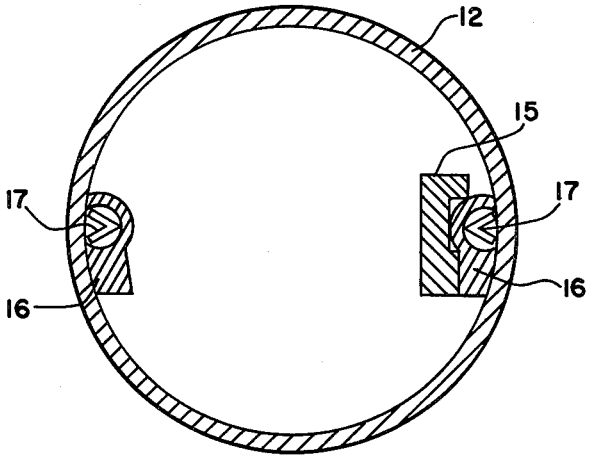

Referring to FIG. 2, a housing 15 which may be a metal fixture, is shown as placed in cannister 12. Metal fixture 15 is attached to cannister 12 and an explosive holder 16 by a set of mounting screws (not shown). Shaped explosive cutting charge 17 and explosive holder 16 extend along the entire internal periphery of cannister 12.

Figure 3:
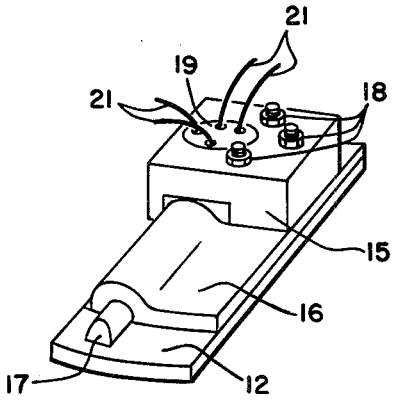
FIG. 3 shows the attachment of the invention to the wall of the cannister.

Referring to FIG. 3, metal fixture 15 is attached to cannister 12 by mounting screws 18 which pass through explosive holder 16. Explosive holder 16 retains shaped explosive cutting charge 17. A potting compound 19, from which a plurality of lead wires 21 emanate, is shown placed in metal fixture 15.

Figure 4:
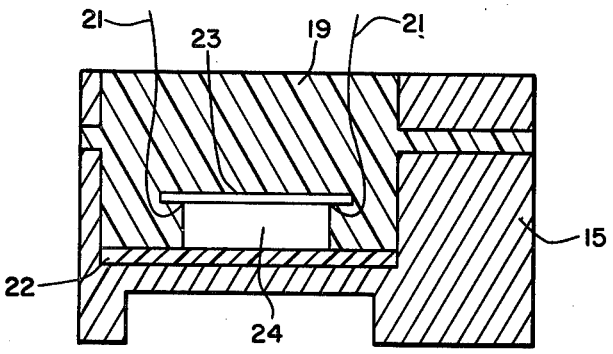
FIG. 4 is a cross section of the invention.

Referring to FIG. 4, metal fixture 15 has a cavity containing a printed circuit board 23 to which an electro explosive link 24 has been attached. Electro explosive link 24 is bonded to the closed end of the cavity in metal fixture 15 by a resilient elastomeric compound 22 which may be a silicon bonding compound or other suitable material. Lead wires 21 emerge from the open end of the cavity in metal fixture 15. Electro explosive link 24, circuit board 23, and lead wires 21 are encased in said cavity by potting compound 19.

Figure 5:
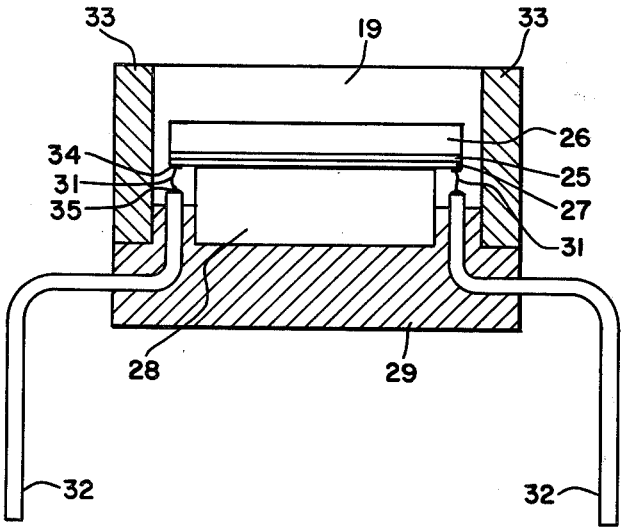
FIG. 5 shows an end view of the electro explosive link.

Referring to FIG. 5, a metallic conductor 25 which may be nichrome or other suitable material, is deposited on a ceramic substrate 26 which substrate may be alumina or other suitable material. The use of metallic conductor 25 is a well known method for insuring a firm conducting base on a nonconducting substrate. A conductor 27, which may be 99.999% gold or other suitable, ductile, conductor is deposited on nichrome layer 25. Deposition of a highly conducting metal on a conducting base provides a reliable conducting means on the ceramic substrate. Substrate 26, along with nichrome layer 25 and conductor 27 are attached to an electrical insulating pad 28. Electrical insulating pad 28, which protects conductor 27 and ceramic substrate 26, attaches to a header 29. A plurality of wires 31, which may be 99.999% gold, electrically connect conductor 27 with a set of header posts 32. Each wire 31 is joined to conductor 27 at conductor terminals 34 and to corresponding header posts 32 at a header post terminal 35. A cover 33 also attaches to header 29. Potting compound 19 fills the remaining area.

Figure 6:
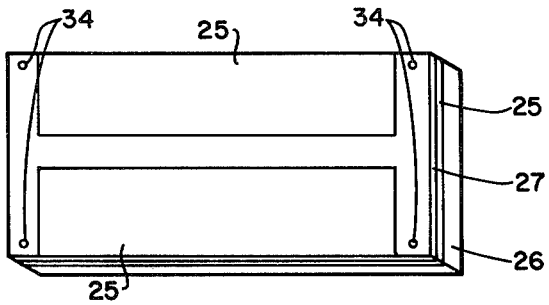
FIG. 6 is one view of a circuit design on the face of the substrate.

Referring to FIG. 6, conductor 27 is deposited on nichrome layer 25 with an "I" configuration in a strip of a predetermined width. Nichrome layer 25 is deposited on ceramic substrate 26. Conductor terminals 34 provide the electrical connection needed to pass the current across conductor 27.

Figure 7:
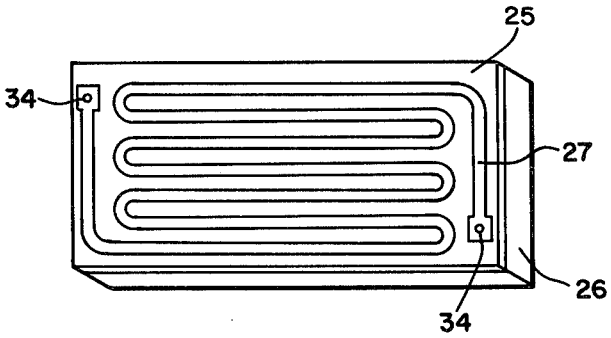
FIG. 7 is an alternative circuit design on the face of the substrate.

Referring to FIG. 7, conductor 27 is deposited on nichrome layer 25 in a strip of predetermined width with a serpentine configuration. Nichrome layer 25 is deposited on ceramic substrate 26. Conductor terminals 34 provide the electrical connection needed in order to pass current across conductor 27.

MODE OF OPERATION

Referring to FIG. 1, aircraft 11 releases cannister 12 containing mines 13. After the release of cannister 12, a shaped explosive cutting charge splits cannister 12 in half releasing mines 13. The present invention senses the shock wave from the shaped explosive cutting charge and activates the timers and batteries in mines 13. Because the cannister splitting occurs very quickly there is very little time between the shaped explosive cutting charge detonation and the release of mines 13. Therefore the arming of mines 13 must be accomplished rapidly. The present invention accomplishes the arming function in 100 microseconds whereas explosive switches may take up to 20 milliseconds. This decrease in activation time results in more reliable arming of mines 13.

A novel feature of the invention is that it can respond quickly and reliably to a large gradient or explosive shock but will not be affected by small gradient or mechanical type shocks even of very high magnitude. Because it is impervious to mechanical shock waves, the invention prevents the accidental arming of mines 13 if cannister 12 is dropped or otherwise mishandled while it is being loaded onto aircraft 11.

Referring to FIGS. 2 and 3, when shaped explosive cutting charge 17 is detonated, cannister 12 is cut in half. The shock wave from shaped explosive cutting charge 17 travels through explosive holder 16, metal fixture 15, and, referring now to FIG. 4, travels through resilient elastomeric compound 22. Referring to FIG. 5, the shock wave next passes through potting compound 19 to fracture ceramic substrate 26, nichrome layer 25, and conductor 27.

Referring to FIG. 4, electro explosive link 24, as illustrated in FIG. 5, is placed in metal fixture 15 with conductor 27 facing away from the origin of the explosive shock wave. By doing this, conductor 27 is separated by the explosive shock wave and the incidence of continuity of any part of conductor 27 after fracture is reduced. Referring again to FIG. 4, metal fixture 15 has a channel on each side into which potting compound 19 is forced in order that the possibility of potting compound 19 being separated from metal fixture 15 is reduced.

Referring to FIG. 5, electrical insulating pad 28 and potting compound 19 are of the same material, namely epoxy resin. Electrical insulating pad 28 is cured epoxy resin while potting compound 19 is uncured epoxy resin. Wires 31 are soldered to header post 32 at header post terminal 35. Wires 31 are ultrasonically bonded to conductor 27 at conductor terminals 34.

Referring to FIG. 6, conductor 27 is plated on nichrome layer 25 in a continuous strip of constant width such that the electrical resistance of conductor 27 is between 0.5 ohms and 5 ohms. This resistance value was arbitrarily selected and other values may be chosen for use with this invention. It is possible to attach either two or four lead wires to conductor terminals 34.

Referring to FIG. 7, conductor 27 is plated on nichrome layer 25 in a continuous serpentine configuration of constant width such that the electrical resistance of conductor 27 is between 0.5 and 5 ohms. This configuration provides for two leads at conductor terminals 34. A serpentine configuration for conductor 27 was used in order to increase the effect of fracture of conductor 27.

The foregoing description taken together with the appended claims constitute a disclosure such as to enable a person skilled in the electric and mechanical engineering arts and having the benefit of the teachings contained therein to make and use the invention. Furthermore, the structure herein described constitutes a meritorious advance in the art which is unobvious to such skilled workers not having the benefit of these teachings.

What is claimed is:

1. An arming system insensitive to mechanical shock which provides a predetermined arming signal upon termination of a preset electric current due to interruption by an explosive shock comprising;

an explosive for creating an explosive shock wave;

a frangible base in proximity to said explosive for sensing said explosive shock wave, such that said frangible base is shattered by said explosive shock wave;

conducting means affixed to said frangible base for transmitting said preset electric current except when said frangible base is shattered;

a resilient elastomeric compound placed between said frangible base and said explosive for cushioning said frangible base such that it is not shattered by mechanical shock;

an electrical insulating pad placed over said conducting means for protecting said conducting means and said frangible base;

housing means for supporting said cushioned and protected frangible base in proximity to said explosive; and potting compound in said housing means for imbedding said frangible base and resilient elastomeric compound in a fixed position within said housing means.

2. An arming system insensitive to mechanical shock as described in claim 1 wherein said conducting means comprises a nichrome layer deposited on said frangible base and a gold conductor deposited on said nichrome layer in a predetermined pattern.

3. An arming system insensitive to mechanical shock as described in claim 1 wherein said frangible base comprises a ceramic substrate.

4. An arming system insensitive to mechanical shock as described in claim 3 wherein said ceramic substrate comprises alumina.

5. An arming system insensitive to mechanical shock as described in claim 1 wherein said electrical insulating pad comprises cured epoxy resin.

6. An arming system insensitive to mechanical shock as described in claim 1 wherein said potting compound is uncured epoxy resin.

7. An arming system insensitive to mechanical shock as described in claim 1 wherein said resilient elastomeric compound is a silicon bonding compound.

8. An arming system insensitive to mechanical shock as described in either of claims 1, 2, 3, 4, 5, 6 or 7 wherein said conducting means is on the opposite side of said frangible base from said resilient elastomeric compound for insuring a break in circuit continuity when said frangible base is shattered.

9. An arming system insensitive to mechanical shock which provides a predetermined arming signal upon termination of a preset electric current due to interruption by explosive shock comprising:

an explosive for creating an explosive shock wave;

a ceramic substrate in proximity to said explosive for sensing said explosive shock wave, such that said ceramic substrate is shattered by said explosive shock wave;

a metallic layer deposited on said ceramic substrate for providing a firm conducting base, said metallic layer deposited on the opposite side of said ceramic substrate from said explosive;

a gold conductor of predetermined shape deposited on said metallic layer for creating a preferred current path for said preset electric current;

a silicon bonding compound placed between said ceramic substrate and said explosive for cushioning said ceramic base such that it is not shattered by mechanical shock;

a cured epoxy resin electrical insulating pad placed over said gold conductor for protecting said conductor and said ceramic substrate;

housing means for supporting said cushioned and protected ceramic substrate and conductor in predetermined proximity to said explosive; and an uncured epoxy resin potting compound in said housing means for imbedding said ceramic substrate and said resilient elastomeric compound in a fixed position within said housing means.

* * * * *